US008465319B2

(12) United States Patent
Regnier et al.

(10) Patent No.: US 8,465,319 B2
(45) Date of Patent: Jun. 18, 2013

(54) CONNECTOR SYSTEM

(75) Inventors: Kent E. Regnier, Lombard, IL (US); Philip J. Dambach, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 55 days.

(21) Appl. No.: 13/059,152

(22) PCT Filed: Aug. 17, 2009

(86) PCT No.: PCT/US2009/054005

§ 371 (c)(1), (2), (4) Date: May 9, 2011

(87) PCT Pub. No.: WO2010/019938

PCT Pub. Date: Feb. 18, 2010

(65) Prior Publication Data

US 2011/0244725 A1 Oct. 6, 2011

Related U.S. Application Data

(60) Provisional application No. 61/089,430, filed on Aug. 15, 2008.

(51) Int. Cl.
*H01R 13/66* (2006.01)

(52) U.S. Cl.
USPC ..... 439/540.1; 439/607.25

(58) Field of Classification Search
USPC ..... 439/676, 540.1, 541.5, 607.23, 607.25
See application file for complete search history.

(56) References Cited

U.S. PATENT DOCUMENTS

| | | | | |
|---|---|---|---|---|
| 7,674,136 | B2 * | 3/2010 | Steinke et al. | 439/676 |
| 2002/0102885 | A1 | 8/2002 | Kline | |
| 2009/0098766 | A1 | 4/2009 | Steinke et al. | |

FOREIGN PATENT DOCUMENTS

| | | | |
|---|---|---|---|
| DE | 20 2004 001202 | | 6/2005 |
| EP | 1 311 038 | A2 | 5/2003 |
| WO | WO 2006/105484 | A1 | 10/2006 |

OTHER PUBLICATIONS

International Search Report for PCT/US2009/054005.

* cited by examiner

*Primary Examiner* — Khiem Nguyen
(74) *Attorney, Agent, or Firm* — Stephen L. Sheldon; Clarence R. Moon, III

(57) ABSTRACT

A connector includes a housing (130) with stacked elongated ports (110*a*, 110*b*). Each of port includes terminals (150*a*, 150*b*) aligned along a vertical side. The top port and the bottom port can be configured so that the terminals are aligned along opposite vertical sides. The terminals can be supported by wafers (170*a*, 170*b*) and the wafer for the top and bottom port can be substantially different heights. The ports can be configured to provide a higher density such as port to port pitch of less than 14 mm.

21 Claims, 15 Drawing Sheets

CONNECTOR SYSTEM

RELATED CASES

This application claims priority to Provisional Application Ser. No. 61/089,430, filed Aug. 15, 2008, which is incorporated herein by reference in its entirety.

BACKGROUND OF THE INVENTION

1. Field of the Invention

The present invention relates to the field of connectors, more specification to a connector system suitable for use with systems with a high number of ports.

2. Description of Related Art

A local area network (LAN) is a common part of modern communication systems. One common configuration of a LAN is a star topology. A hub is placed in a desired location and a number of cables are run from the hub to individual devices or other hubs. While LANs enable a large number of applications and processes that would be difficult or impossible without the LAN (such as voice over IP phones), their use also raises certain issues. In large facilities, a communication closet or room is provided with a number of racks of communication equipment, such as servers, hubs, and the like. Hubs may be mounted on communication racks and include, for example, 48 RJ-45 ports per hub so that each hub may be coupled to 48 cables, each cable including 4 twisted pair of wires. Because of space requirements in many facilities, however, it is often extremely difficult to add additional hubs once the space for communication racks is taken. Therefore, as the desire to connect additional equipment to the network arises, significant space issues arise.

BRIEF SUMMARY OF THE INVENTION

A connector system for coupling a plug to a circuit board is disclosed. The connector system is mounted on a circuit board and includes an array of ports that includes an upper and a lower port. A wafer that includes a plurality of terminal is mounted to the circuit board and coupled to a shoulder in each port. The housing may be surrounded by a shield. In an embodiment, the wafer may be configured to provide terminals for either the upper or lower port. A first orientation of the terminals in the upper port may be 180 different than a second orientation of the terminals in the lower port.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
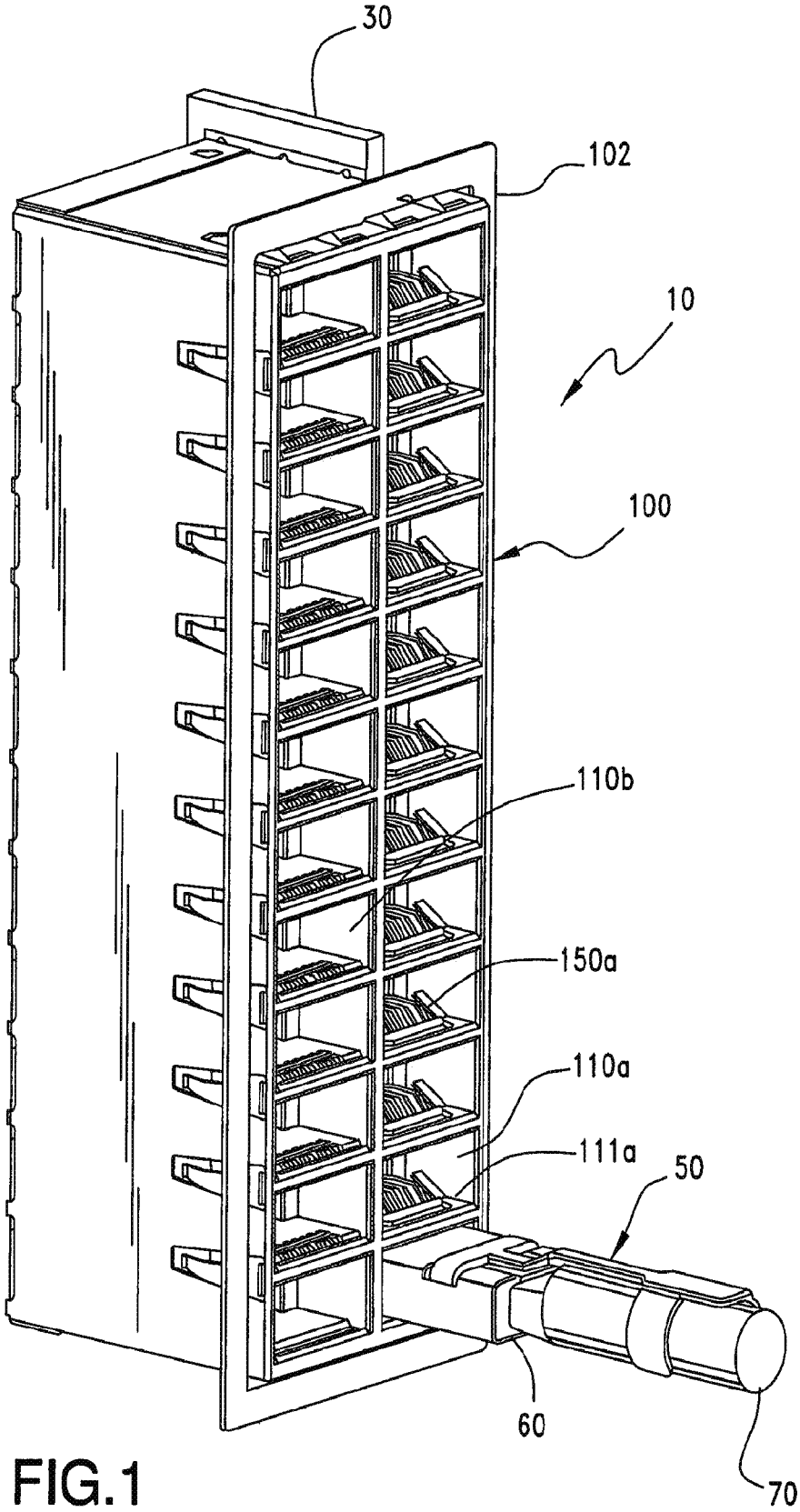
FIG. 1 illustrates a perspective view of an exemplary embodiment of a connector system for use with twisted pair cabling.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1-15 illustrate features that can be used in a system 10. As depicted, the system 10 includes a connector 100 mounted to a circuit board 30 with a cable system 50 mated to the connector 100. The connector 100 includes a first port 110*a* and a second port 110*b* that, as depicted, are provided in two rows and in an embodiment the connector 100 can have a density that is double the typical RJ-45 density (e.g., 96 ports instead of the usual 48 ports can be provided in a rack mountable unit of comparable size). The first and second port 110*a*, 110*b* include terminals 150*a*, 150*b* that are positioned on first wall 111*a*, 111*b* of the ports. The cable system 50 includes a plug 50, which is mated to a cable 70 and the cable 70 may include 4 twisted pairs of conductors. A latching system 120, which can be any desirable latching system, helps secure the plug 50 in one of the ports. Thus, the latching system could be a tab, notch or biased member that releaseably engages a plug so as to help ensure the plug reliably engages the connector 100. A shield 105, which may include conductive fingers 108 for mating with a bezel 102, is provided and extends around a housing 130. As shown, the shield 105 extends around substantial portion of the housing 130 external area and may be coupled to the circuit board 30 so as to provide a ground plane.

Figure 2:
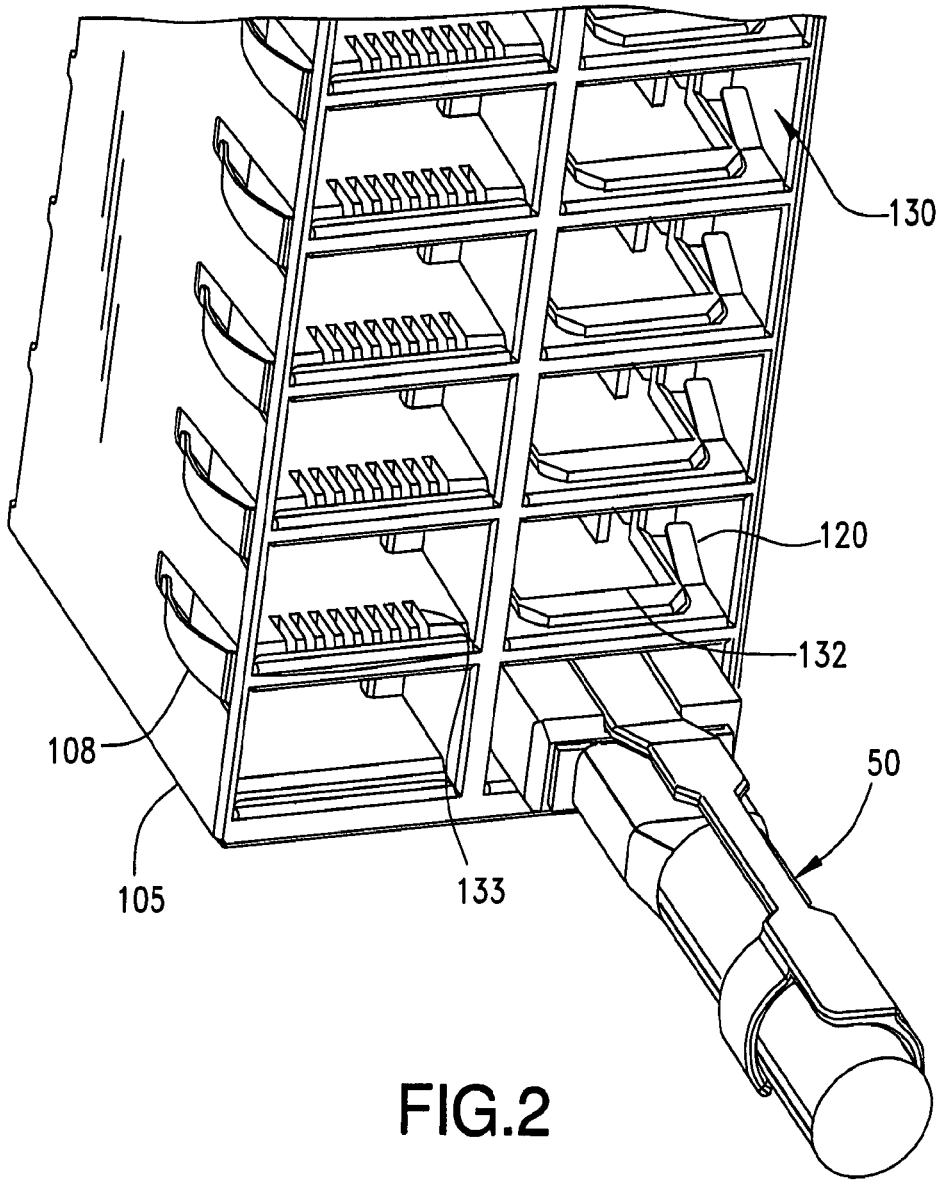
FIG. 2 illustrates a perspective view of an embodiment of a plug positioned in a port of a receptacle.

FIG. 2 shows a simplified connector without terminals and the housing 130 includes a shoulder 132 which helps restrain the terminals in position. To help improve electrical performance, the housing 130 includes air slots 132 that can be provided between terminals.

Figure 3:
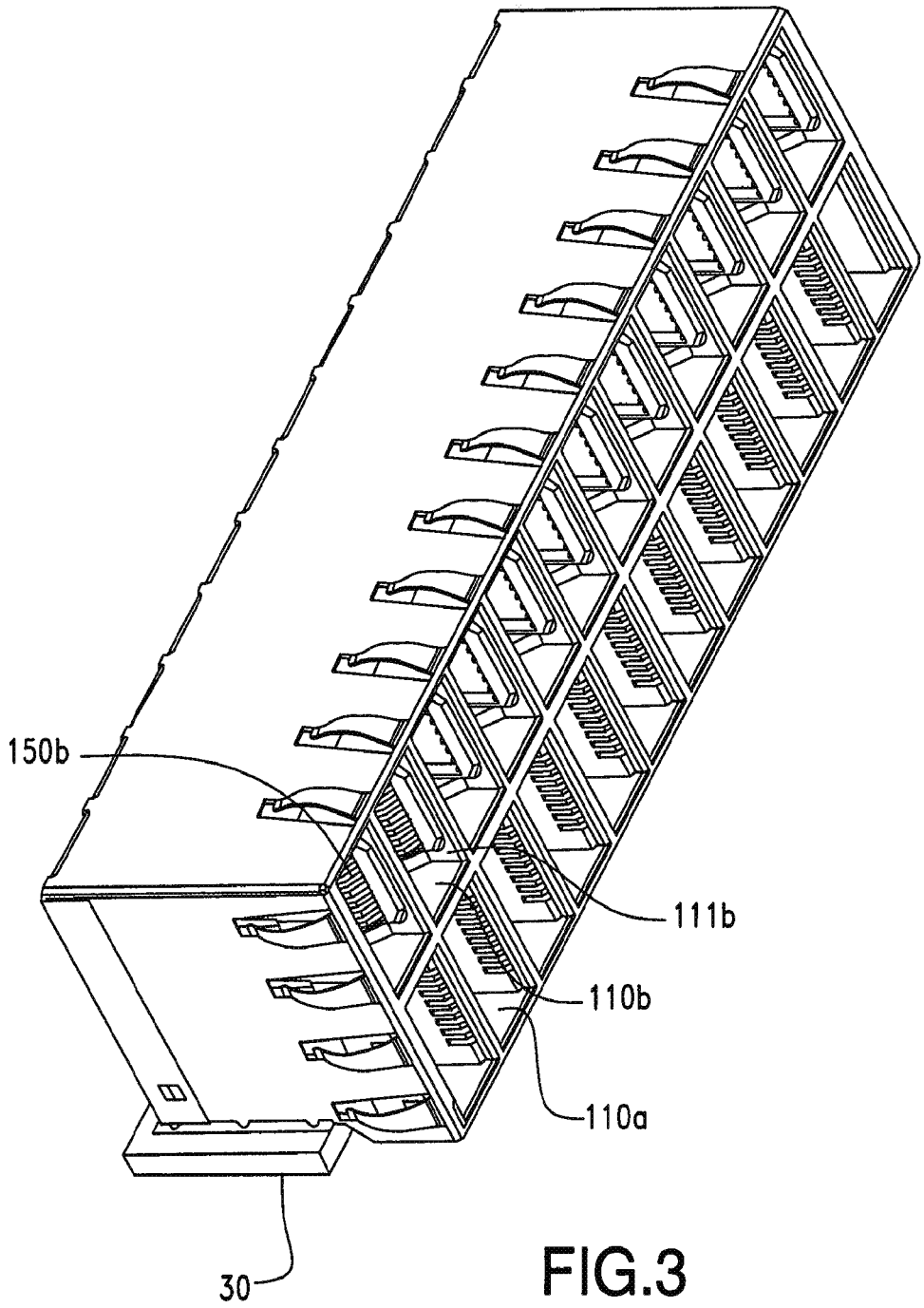
FIG. 3 illustrates a perspective simplified view of an embodiment of a connector mounted to a circuit board.
Figure 5:
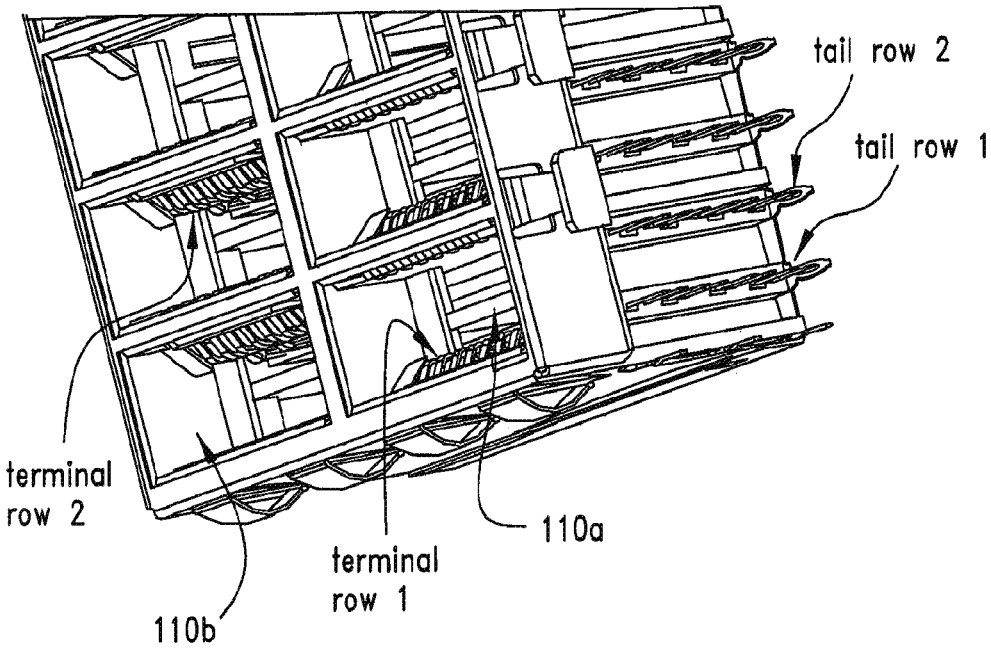
FIG. 5 illustrates a perspective enlarged view of the connector illustrated in FIG. 4.

As can be appreciated from FIGS. 1, 3 and 5, the first port 110*a* and the second port 110*b* are depicted as both having an elongated, rectangular shape and also having an orientation that is 180 degrees different. The orientation is provided by a providing the first port 110*a* with a first terminal row on one side and the second port 110*b* with a second terminal row on the opposite side. Thus, compared to convention ports these ports are orientated sideways an in a column comprising two stacked ports, the column having a vertical orientation if the circuit board is considered to have a horizontal orientation. Furthermore, the first sides are parallel to the column orientation. As can be appreciated, these features are allowed by the wafer construction that is discussed below in greater detail. One result of the depicted configuration is that the mating plug in the first (e.g., bottom) port 110*a* will have a first orientation and the plug in the second (e.g., top) port will have a second orientation that is 180 degrees different than the first orientation.

Figure 4:
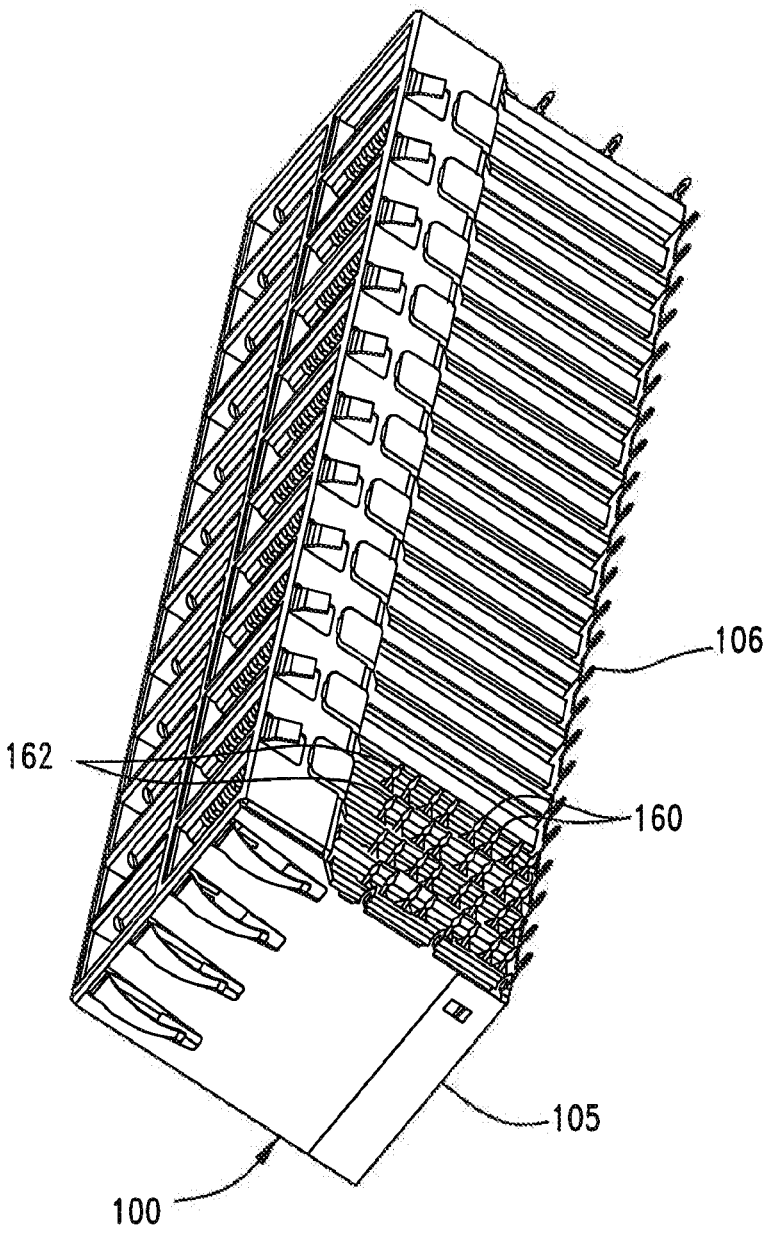
FIG. 4 illustrates a perspective simplified view of a bottom of a connector.

As can be appreciated from FIG. 4, the connector 100 can be configured so that the terminals are aligned in a row 162 that provides for a plurality of differential pair 160. It should be noted, however, that the terminals may also be aligned in a seesaw pattern as well (e.g., by not centering the terminals in a single line). To help provide electrical shielding, the shield 105 may include tails 106 that can engage the circuit board and help provide a ground plane that at least partially surrounds the housing 130. It should be noted, however, that in an embodiment the wafers do not support any ground terminals directly. The omission of ground terminals, whether as conventional terminals in the wafer or as a shield positioned between adjacent wafers, does simplify the connector construction and reduces costs but makes providing the desired electrical separation more challenging.

The terminals 150 are supported in a first wafer 170*a* and second wafer 170*b* and in an embodiment may be insert molded in the wafer. As can be appreciated from FIGS. 14 and 15, in an embodiment, the wafer may be comprised of two halves, both with four terminals, so that when the two halves are combined the four terminals in the first half are broadside coupled to the four terminals in the second half. The wafers can then be mounted in the housing so that terminals extend from the port to a board mounting location. Recesses 177 in the wafer halves could be provided to allow the terminals tails to be transition toward the center so that the tails could be positioned in a single line. Alternatively, the depicted eight (8) terminals could be mounted insertion molded in a wafer that did not include halves combined together.

As depicted, each of the first and second wafer 170*a*, 170*b* supports eight (8) terminals 150, which corresponds to four (4) twisted pairs commonly found in Category 5e cable (which is a design similar to many cables used for Ethernet communication in many facilities). Of course, other categories of cable would also be suitable for use with plugs that mate to depicted connector. In an alternative embodiment, the wafers could be configured for a different number of terminals.

Figure 6:
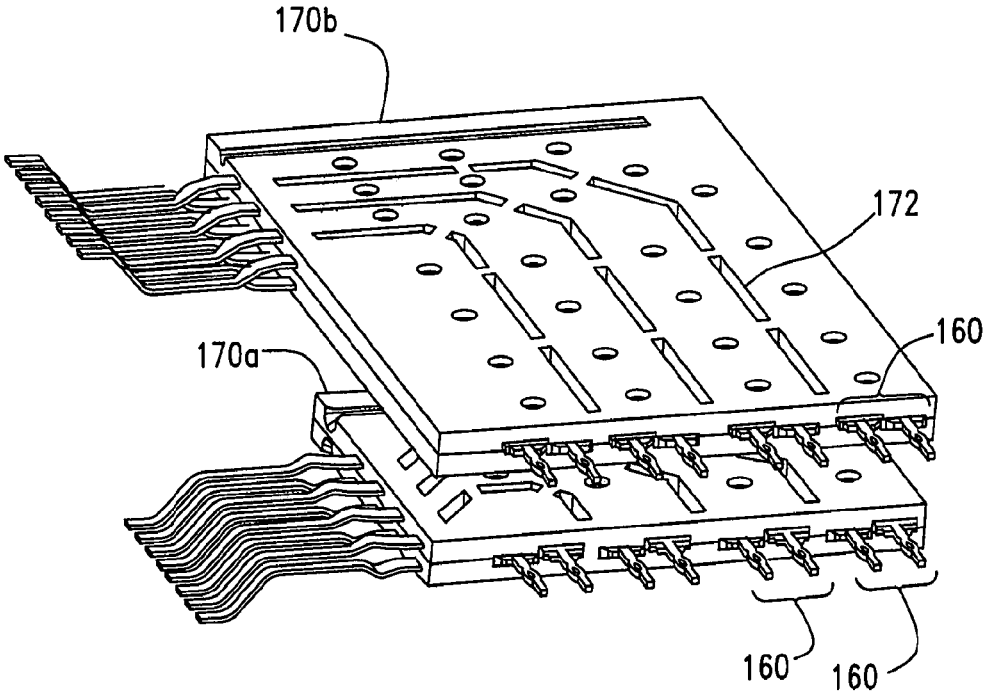
FIG. 6 illustrates a perspective view of an embodiment of a first and second wafer.
Figure 7A:
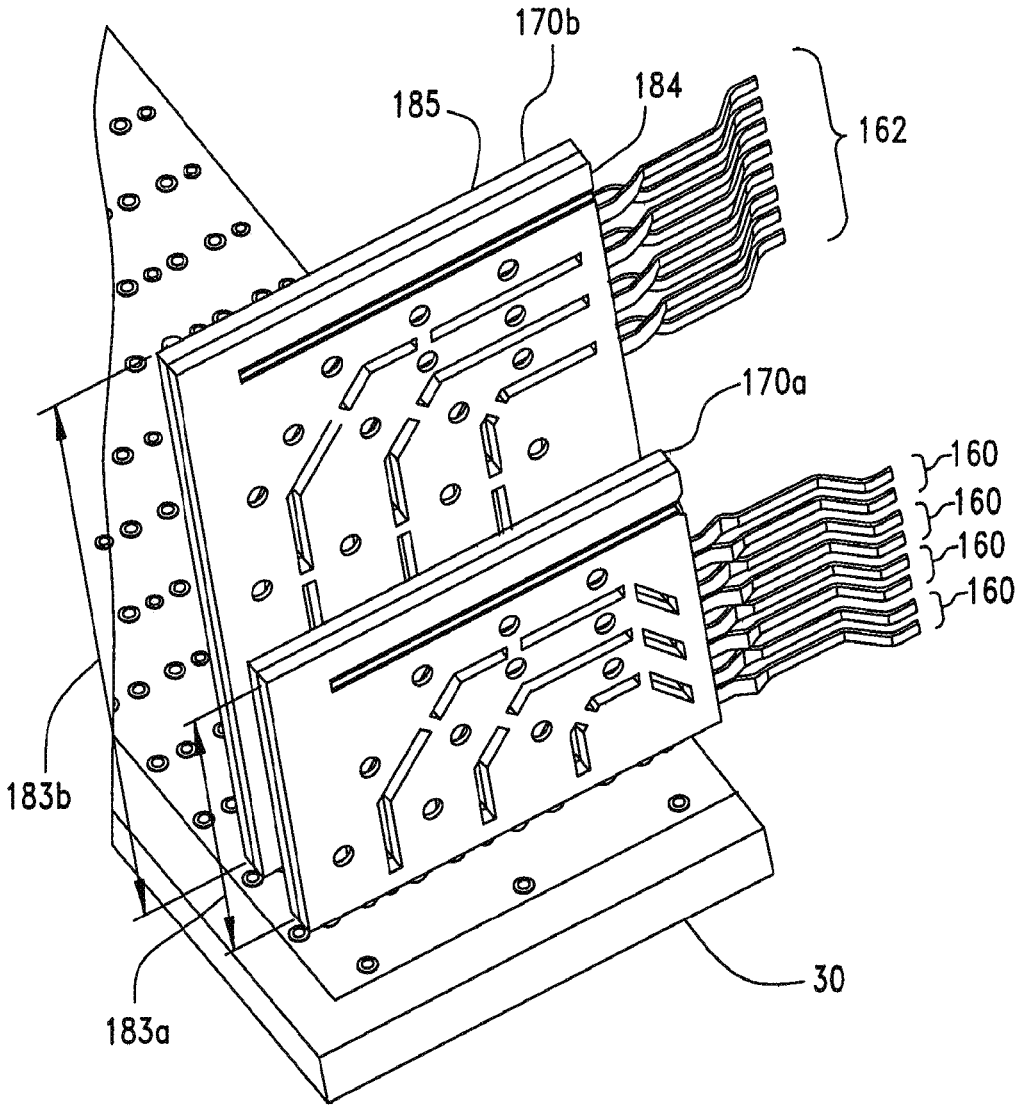
FIG. 7*a* illustrates a perspective view of a first and second wafer mounted on a circuit board.
Figure 7B:
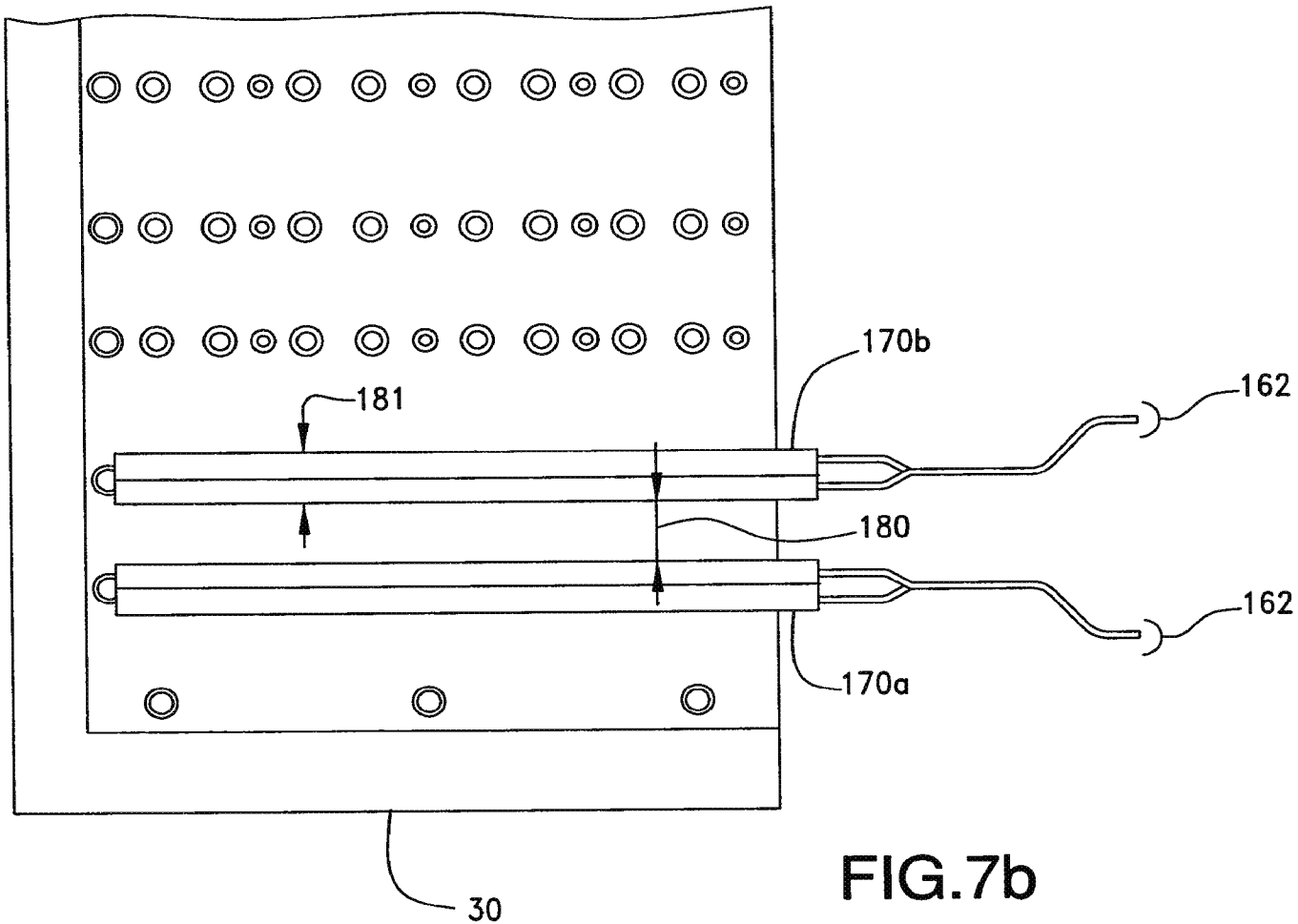
FIG. 7*b* illustrates an elevated plan view of the wafers depicted in FIG. 7*a*.
Figure 8:
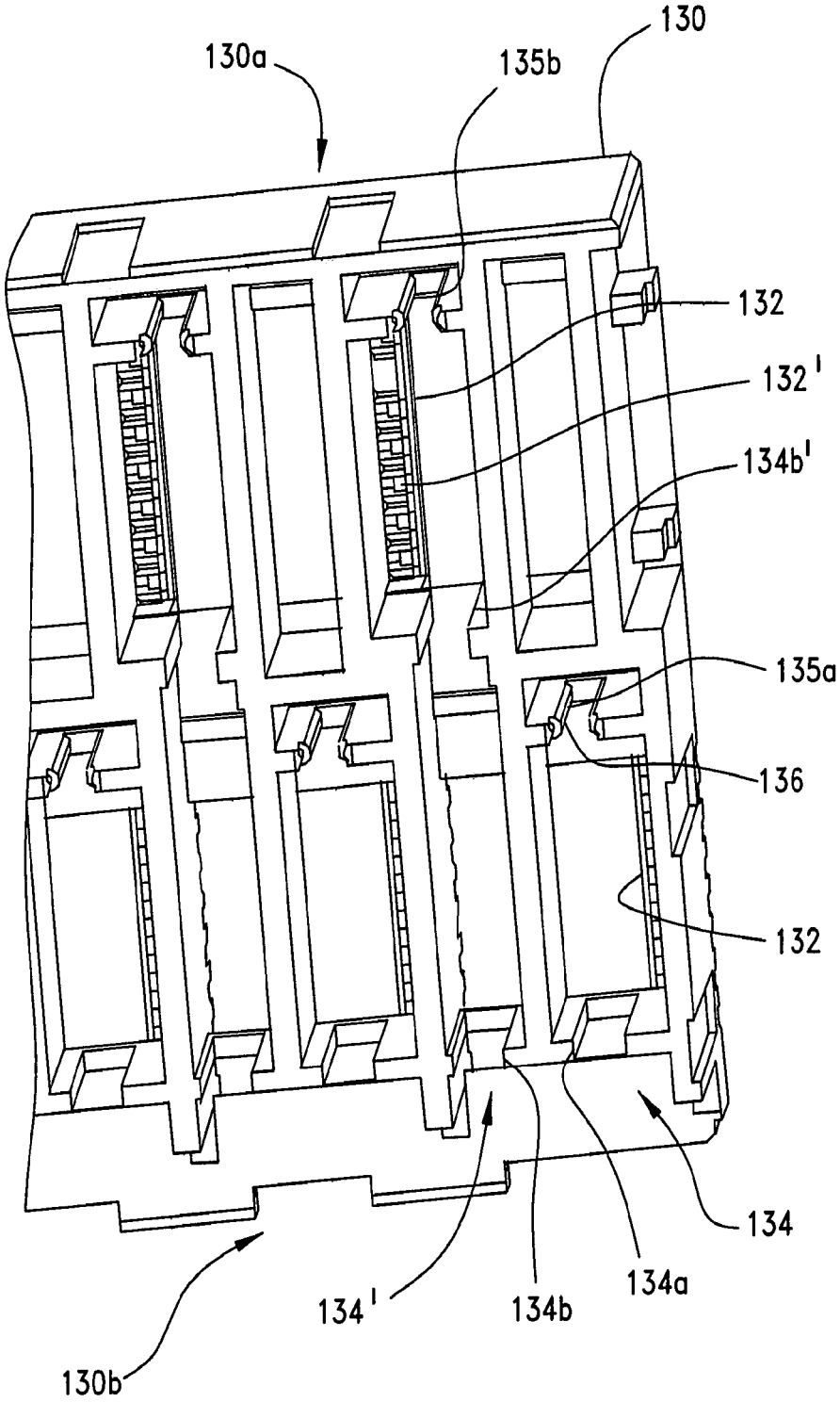
FIG. 8 illustrates a rear perspective view of a portion of a connector housing.
Figure 9:
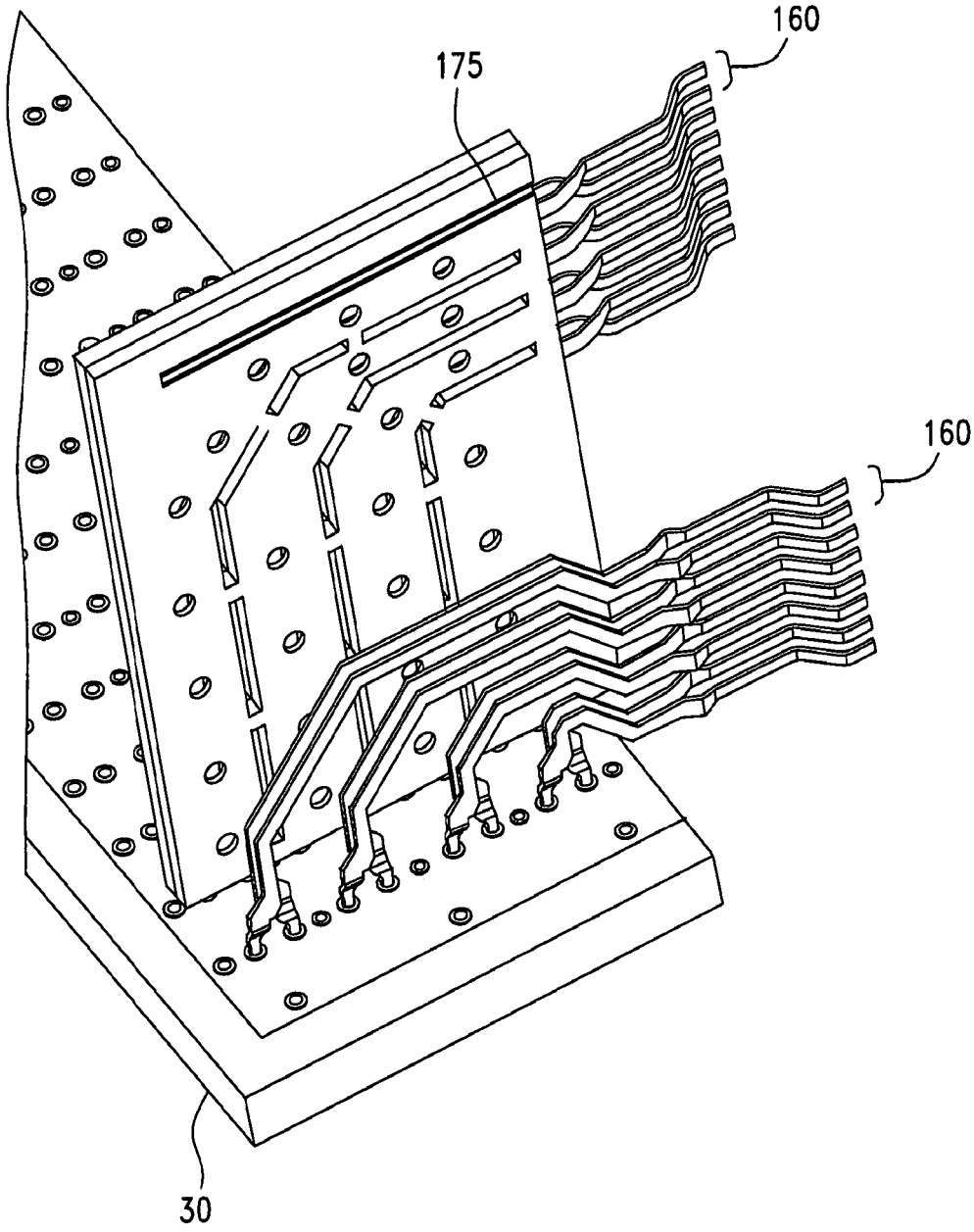
FIG. 9 illustrates a perspective simplified view of the wafers depicted in FIG. 7*a*.
Figure 10:
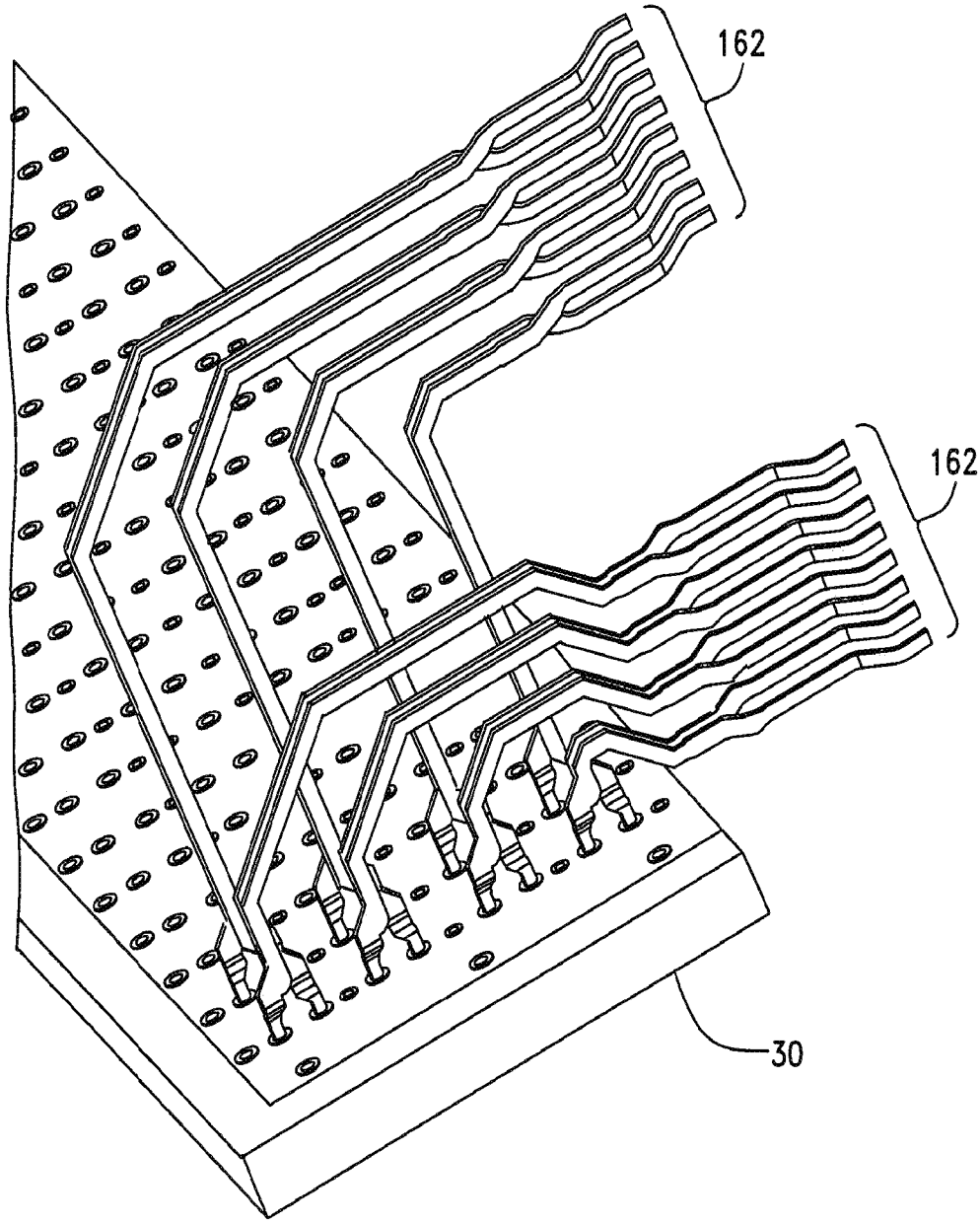
FIG. 10 illustrates a perspective further simplified view of the wafers depicted in FIG. 9.
Figure 11A:
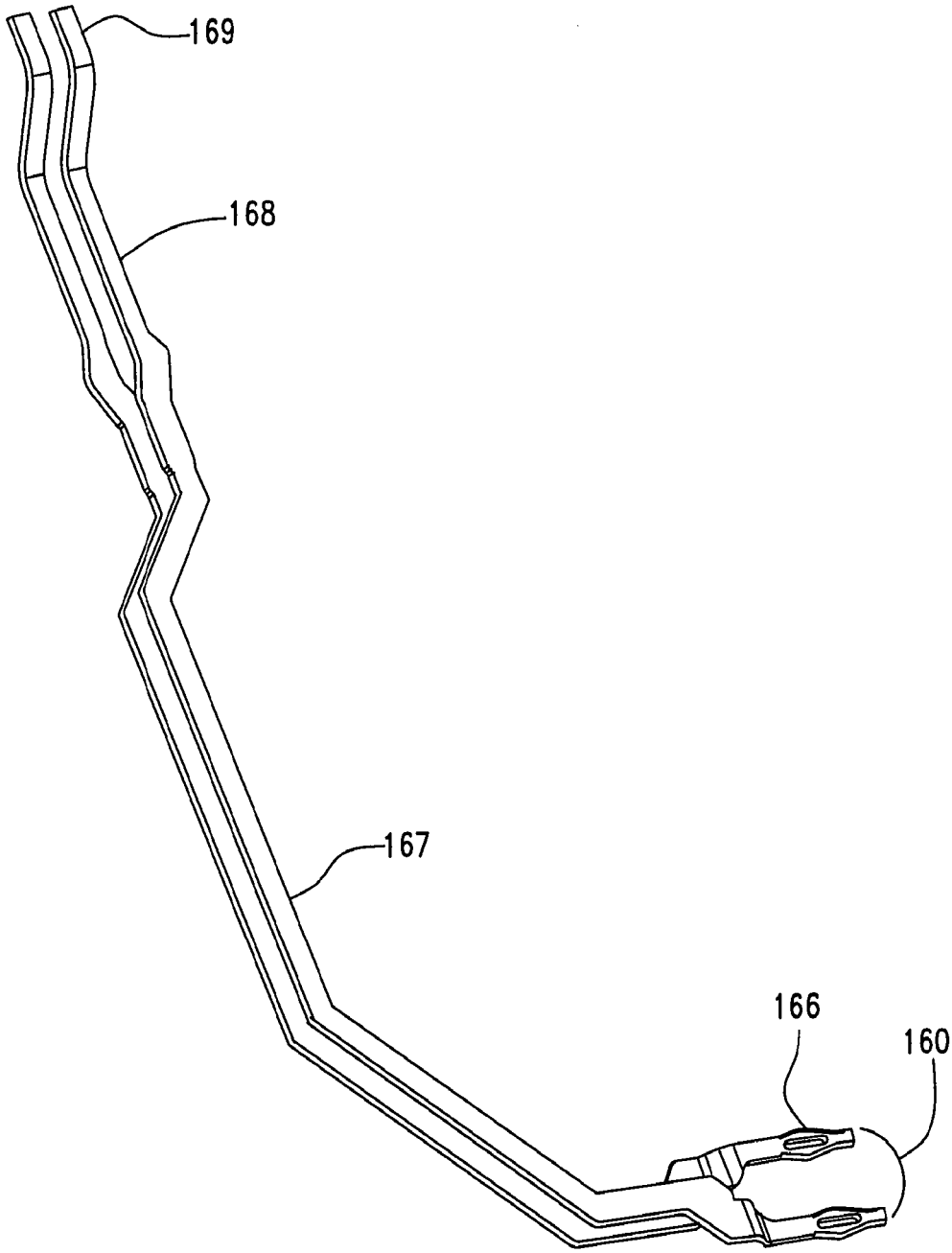
FIG. 11*a* illustrates a perspective view of an embodiment of a pair of terminals.
Figure 11B:
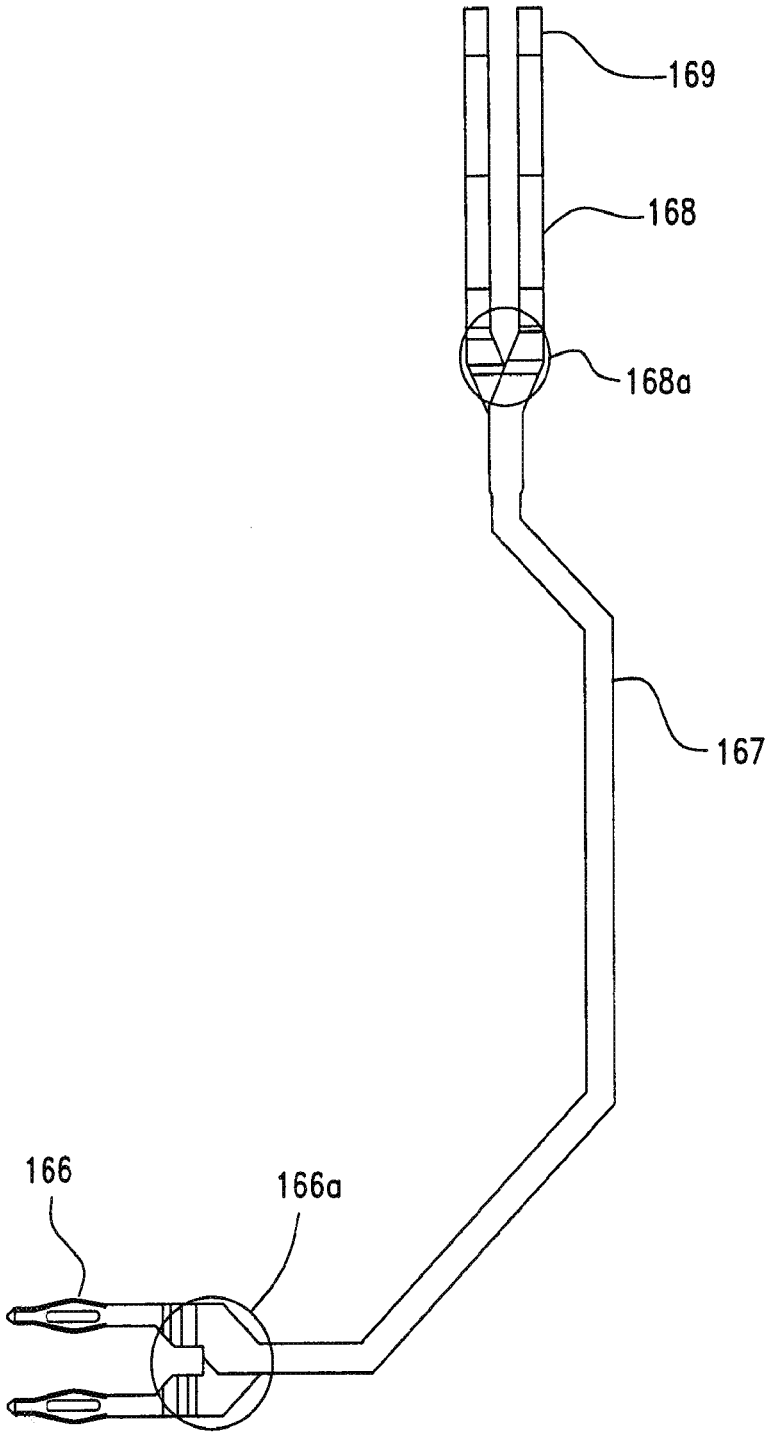
FIG. 11*b* illustrates an elevated side view of the terminals depicted in FIG. 11*a*.
Figure 11C:
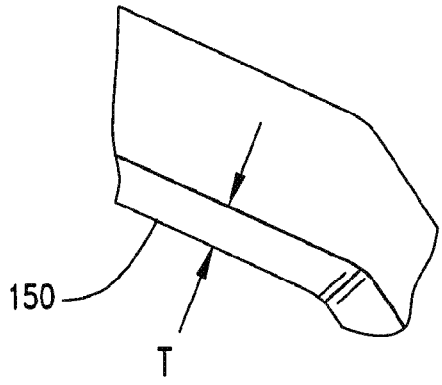
FIG. 11*c* illustrates a close-up view of a portion of one of the terminals depicted in FIG. 11*a*.
Figure 12:
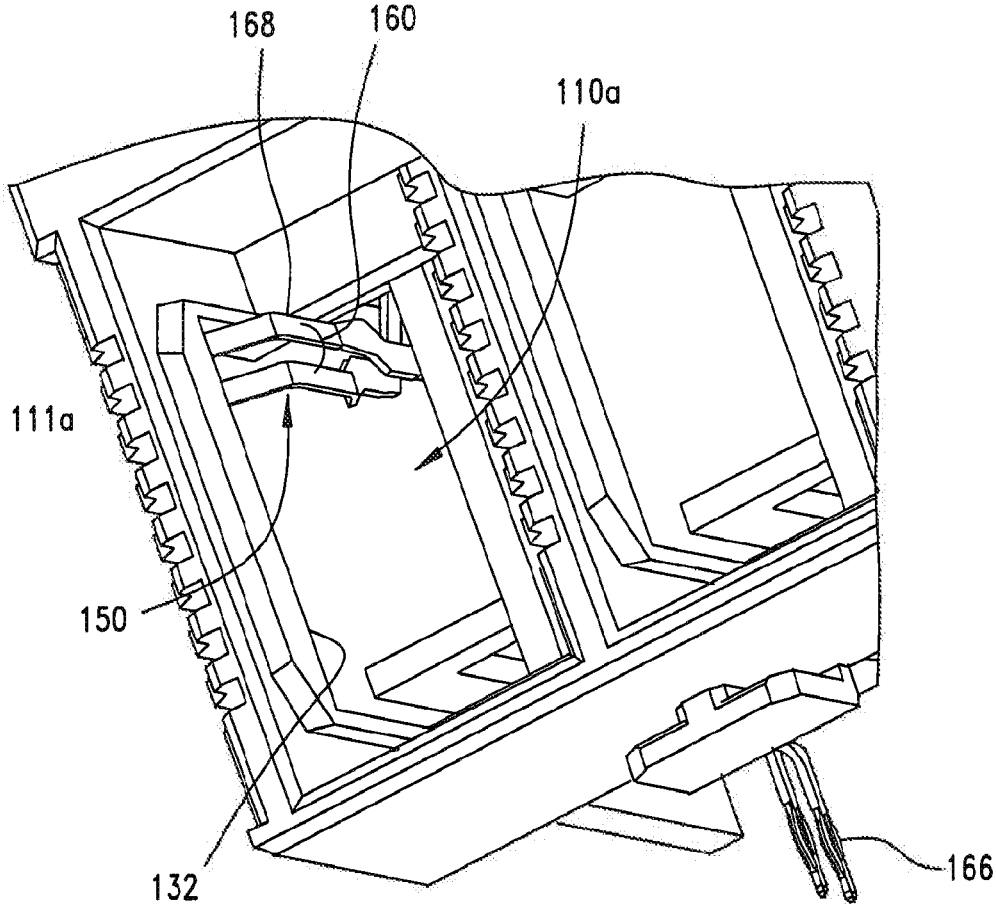
FIG. 12 illustrates a perspective simplified view of an embodiment of a port.

As depicted in FIGS. 6-7, the first and second wafers 170*a*, 170*b* are provided in two configurations and both have a first (or top) surface 185 and a front face 184. The first wafer 170*a* has a first height 183*a* (e.g., has a short configuration which may extend so as to provide a top surface about 12 mm off the circuit board) and the second wafer 170*b* has a second height 183*b* (e.g., has a tall configuration with a top surface about 24 mm above the circuit board). In an embodiment, the first height 183*a* can be about half the second height 183*b*. Because they are aligned in planes, the first and second wafer are depicted as being configured so that the first wafer 170*a* is aligned with a first direction and the second wafer 170*b* is aligned with an opposite second direction. As can be appreciated, the terminals 150 extending from the front face of the wafers can be configured to extend in a direction that is parallel to a mounting plane formed by the circuit board 30. In an embodiment, the terminals from the second wafer 170*b* can be configured so that they are positioned farther away from the mounting plane formed by the circuit board 30 than the top surface 185 of the first wafer 170*a*.

Figure 13:
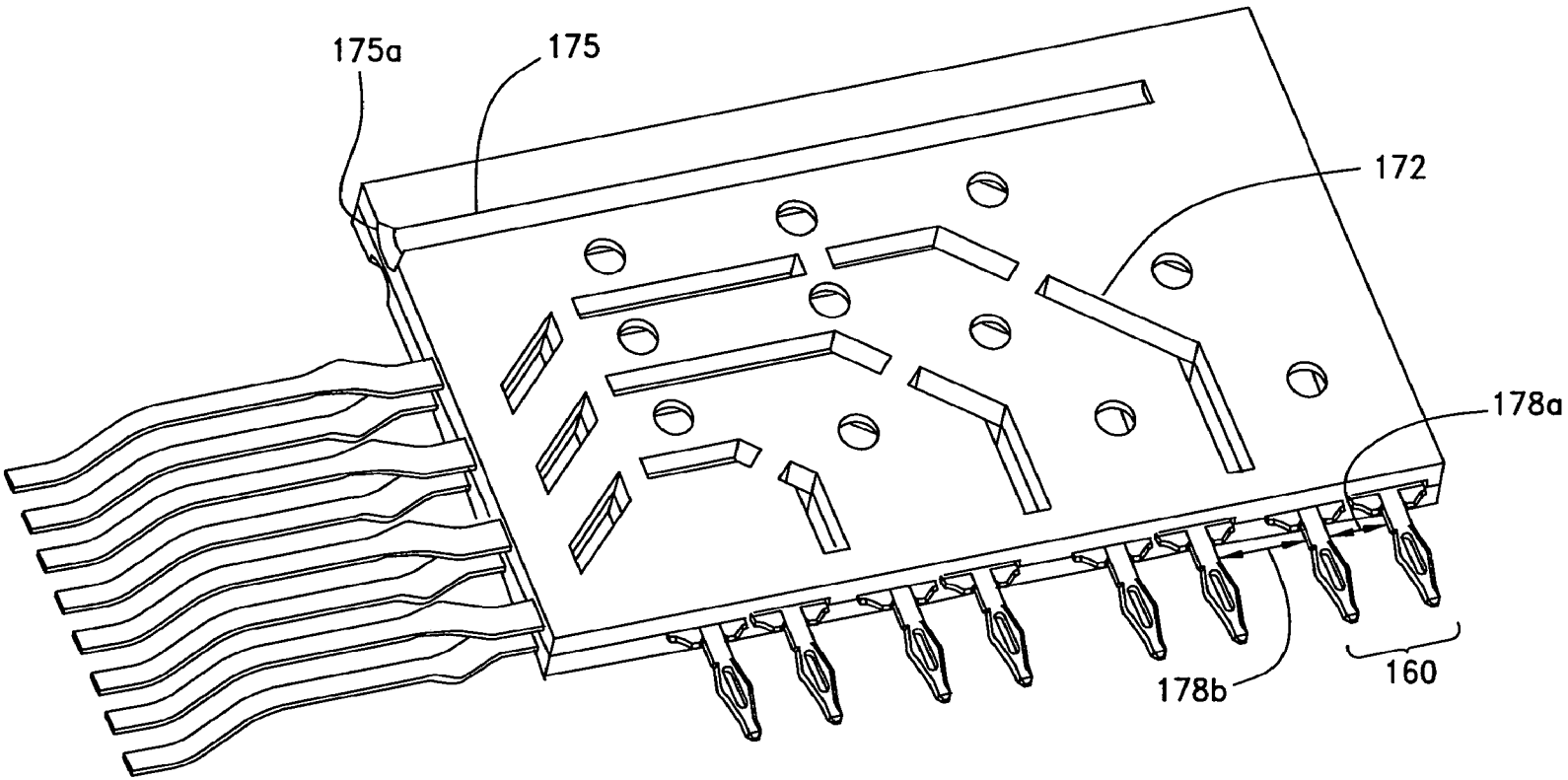
FIG. 13 illustrates a perspective view of an embodiment of a wafer.
Figure 14:
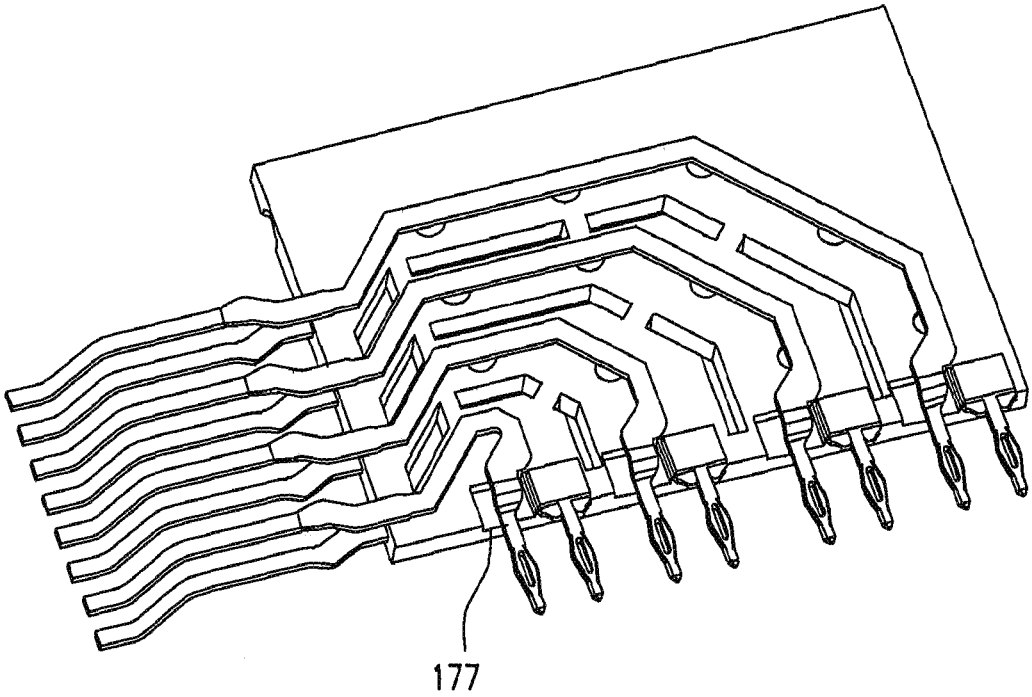
FIG. 14 illustrates a perspective partial view of the wafer depicted in FIG. 13 with the dielectric removed from a portion of the terminals for purposes of illustration.
Figure 15:
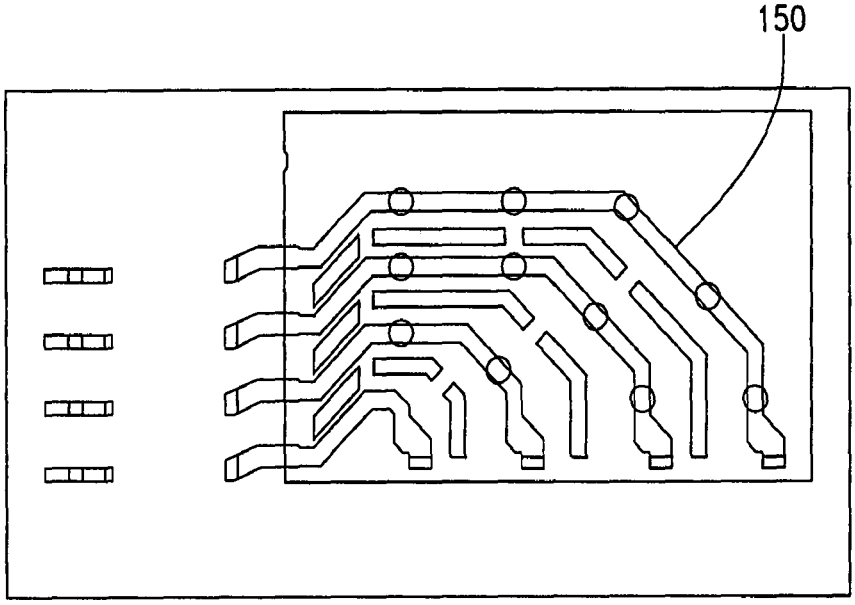
FIG. 15 is a cross-section of a portion of the wafer depicted in FIG. 13.

The wafers have a thickness 181 and can be separated by distance 180. In an embodiment, the distance 180 can be greater than the thickness 181. As can be appreciated, this helps increase electrical separation between adjacent ports and therefore acts to improve port-to-port crosstalk. To improve crosstalk between terminal pairs 160 in the same port, the terminals are configured to be broadside coupled in the wafer and there is a greater space between tails of terminals that are part of different pairs than there are between terminals of a pair. In other words, distance 178*a* is less than distance 178*b* (FIG. 13). To provide further electrical separation between pairs, an air channel 172 can be provided between adjacent terminal pairs 160 of each wafer. In an embodiment, the air channel can extend substantially the entire distance that the terminal pair 160 extends through the wafer in a broadside coupled manner.

As depicted, the terminals include a tail portion 166, a body portion 167 (which as depicted is broadside coupled to another terminal to form the terminal pair 160) and a contact portion 168 that is used as the interface for coupling with a mating plug. A first transition portion 166*a* is provided between the tail portion 166 and the body portion 167 and a second transition portion 168*a* is provided between the body portion 167 and the contact portion 168. As depicted, the transition portions are used to bring the terminals from an in-line edge coupled configuration to the broadside coupled configuration. To support the contact portion 168, the terminals 150 may further in a support tip 169. The support tip 169 is supported by shoulder 132 and may be positioned in notches 132' in the shoulder 132.

The first and second wafer 170*a*, 170*b* are configured to be inserted into first and second channels 134, 134' in the housing 130 from a second side 130*b* (the ports are thus provided on a first side 130*a*). As depicted, the first channel 134 includes a lower notch 134*a* and an upper notch 135*a*. The second channel 134' includes a lower notch 134*b*, an intermediate notch 134'*b* and an upper notch 135*b*. The upper notch 135*a*, 135*b* can be configured to include a rounded surface 136 configured to engage a groove 175 in the respective wafer and to help insertion of the wafer into the housing, the groove 175 can include a chamfer 175*a*. When the wafers are mounted in the housing, the first wafer 170*a* will correspond to a connector being mounted in a first orientation and the second wafer 170*b* will correspond to a connector being mounted in a second orientation that is 180 degrees different (e.g., opposite) than the first orientation.

This alternating pattern may be repeated along the length of the connector. This allows the wafers to be placed in the housing in a space that is close to the thickness of the two wafers while providing desirable electrical separation between pairs in adjacent wafers. Therefore, the space required in the housing can be reduced, allowing for a more dense packing of connectors such as having a row of ports with the ports having a 7 mm pitch (e.g., allowing for a doubling of density compared to a convention RJ-45 connector system which is difficult to lower below about 14 mm given the RJ-45 connector is about 12 mm wide). Naturally, the pitch could be some other number such as 8 or 9 or 10 mm and still provide a significant improvement in port density. As can be appreciated, therefore, in a housing with the depicted wafer configuration, a first row of ports will be in a first orientation and the second row of ports will be in a second orientation that is a 180 degree different from the first orientation and each row can have a pitch that is smaller than possible with RJ-45 connectors.

As illustrated, therefore, the terminals can be mounted to a board, such as a conventional printed circuit board. The terminals are arranged so that they are configured in a broadside coupled manner for a substantial portion of the distance they extend between the opposite ends of the terminals while providing increased separation (preferably physical as well as electrical separation) between adjacent pairs of broadside coupled pairs of terminals. This has the tendency to improve electrical performance for the pairs in a cable. The terminals 150 then mount in the shoulder 132 in the housing 130 where they can be coupled to a corresponding connector. Electrical separation between wafers is improved by maintaining a distance between adjacent wafers. Thus, the depicted connector design can accept plugs that are coupled to twisted pairs and provide improved electrical performance as compared to conventional ports for RJ-45 connectors and at the same time provide substantially greater density.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A connector receptacle system, comprising:

a shield;

a housing positioned in the shield and having a first and second port, the second port positioned above the first port, each port having an elongated shape and a first side and being configured to receive a plug connector, the first side of the first and second ports being orientated in opposite directions;

a first wafer supporting a first row of terminals, the first wafer configured to provide a first row of vertically orientated signal terminals on the first side of the first port; and a second wafer supporting a second row of terminals, the second wafer configured to provide a second row of vertically orientated signal terminals on the first side of the second port.

2. The connector of claim 1, wherein the first wafer is about half a height of the second wafer.

3. The connector of claim 1, wherein the terminals in the first wafer are configured to provide four (4) pairs of broadside coupled terminals.

4. The connector of claim 3, wherein the wafer includes air channels between each pair of broadside coupled terminals.

5. The connector of claim 3, wherein the terminals in the first wafer have tails configured for through-hole mounting and the tails of the pairs of broadside coupled terminals are closer together than the tails of terminals in adjacent pairs.

6. The connector of claim 1, wherein there are no ground terminals between or in the first and second wafers.

7. The connector of claim 1, wherein the first wafer and the second wafer are two adjacent wafers with a first width and are spaced apart a distance greater than the first width.

8. A connector for mounting on a circuit board, comprising:

a shield having tails to engage the circuit board;

a housing positioned in the shield and having a first and second port, the second port positioned above the first port in a stacked configuration, each port having an elongated shape and a first side and being configured to receive a plug connector, the first side of the first and second ports being orientated in opposite directions;

a first wafer supporting a first row of signal terminals in the first port, the first wafer having a first height; and a second wafer supporting a second row of signal terminals in the second port, the second wafer having a second height, the second height being about twice the first height.

9. The connector of claim 8, wherein the first wafer has a groove that is configured to be parallel to the circuit board and that is configured to align the wafer with the housing and the groove is positioned, when the connector is mounted to the circuit board, closer to the circuit board than the second row of terminals in the second port.

10. The connector of claim 8, wherein the connector is configured to mount on a mounting plane formed by the circuit board and each of the terminals have a contact portion that extend parallel to the mounting plane and a tail potion that extend perpendicular to the mounting plane, wherein the contact portions of the second wafer are positioned farther away from the mounting plane than a top of the first wafer.

11. The connector of claim 10, wherein the first wafer includes a groove with a chamfer that is parallel with the mounting plane, the groove configured to engage the housing so as to retain the wafer in the housing.

12. The connector of claim 8, wherein the first and second wafers support the same number of terminals.

13. The connector of claim 8, wherein the first and second wafer wafers do not support ground wafers.

14. A connector system, comprising:

a shield;

a housing positioned in the shield and having a first and second port on a first side, the second port positioned above the first port in a stacked configuration so as to provide an upper port row and a lower port row, each of the first and second ports having an elongated shape and a first side and being configured to receive a plug connector, the first side of the first and second ports being orientated in opposite directions, the housing further including a first and second channel corresponding to the first and second ports, respectively, wherein the first and second ports form a column and the first side is parallel to the column orientation;

a first wafer positioned in the first channel and supporting a first row of signal terminals and having a first height; and a second wafer positioned in the second channel and supporting a second row of signal terminals and having a second height, the second height being at least about twice the first height.

15. The connector system of claim 14, wherein the first channel is about half the height of the second channel.

16. The connector system of claim 14, wherein each of the first and second ports have a first side with a shoulder, wherein the terminals include support tips and the support tips are restrained by the shoulder.

17. The connector system of claim 16, wherein a plurality of notches are provided in the shoulder and each of the terminals is supported by one of the notches.

18. The connector system of claim 14, wherein there are air slots in the housing between each of the support tips.

19. The connector system of claim 14, wherein the first and second wafers do not support ground terminals.

20. The connector system of claim 14, wherein the first and second wafers respectively have a first and second thickness and the first and second wafers are separated by a distance and the distance is greater than the first or the second thickness.

21. The connector system of claim 14, wherein the connector comprises a plurality of the first and second ports in the first and second rows and the ports are at a pitch that is less than 8 mm.

* * * * *